US009470014B2

(12) United States Patent
Volin

(10) Patent No.: US 9,470,014 B2
(45) Date of Patent: Oct. 18, 2016

(54) FENCE CLIPPING SYSTEM HAVING FLEXIBLE ARM AND DOUBLE-LOCKING-HEAD ARM FOR HANGING FENCE PANELS ON ONE SIDE OF FENCE POSTS

(71) Applicant: Dee Volin, Fairview, OR (US)

(72) Inventor: Dee Volin, Fairview, OR (US)

( * ) Notice: Subject to any disclaimer, the term of this patent is extended or adjusted under 35 U.S.C. 154(b) by 233 days.

(21) Appl. No.: 14/458,930

(22) Filed: Aug. 13, 2014

(65) Prior Publication Data

US 2015/0048290 A1 Feb. 19, 2015

Related U.S. Application Data

(60) Provisional application No. 61/867,062, filed on Aug. 17, 2013.

(51) Int. Cl.
*E04H 17/16* (2006.01)

(52) U.S. Cl.
CPC ..... *E04H 17/161* (2013.01); *Y10T 29/49826* (2015.01)

(58) Field of Classification Search
CPC ..... E04H 17/04; E04H 17/10; E04H 17/161; E04H 17/16; Y10T 29/49826
USPC ..... 256/24, 47, 54, 59, 65.08, 73; 29/428
See application file for complete search history.

(56) References Cited

U.S. PATENT DOCUMENTS

| | | | | |
|---|---|---|---|---|
| 221,878 A | | 7/1879 | Taylor | |
| 351,244 A | | 2/1886 | Baines | |
| 379,706 A | | 11/1887 | Landis | |
| 385,531 A | | 4/1888 | Shrader | |
| 386,721 A | | 5/1888 | Rickards | |
| 473,028 A | | 6/1890 | Stewart | |
| 603,628 A | | 10/1897 | Ferguson | |
| 611,913 A | | 2/1898 | Kees | |
| 1,407,540 A | | 7/1919 | Holsinger | |
| 2,218,954 A | | 8/1939 | Gustafson | |
| 2,863,642 A | | 5/1955 | Pagett | |
| 2,800,305 A | | 8/1955 | Gerstner | |
| 3,045,976 A | | 3/1961 | Nayhouse | |
| 3,089,681 A | * | 5/1963 | Smithwick | E04H 17/10 256/23 |
| D197,233 S | | 12/1963 | Burnstine | |
| 3,486,739 A | | 12/1969 | Nelson | |
| 3,942,763 A | | 3/1976 | Helterbrand | |
| 3,972,510 A | * | 8/1976 | Dougherty | E04H 17/003 256/11 |

(Continued)

FOREIGN PATENT DOCUMENTS

| | | | | |
|---|---|---|---|---|
| FR | 2905715 A1 | * | 3/2008 | E04F 11/181 |

*Primary Examiner* — Gregory Binda
*Assistant Examiner* — Nahid Amiri

(57) ABSTRACT

A plasticized fence clipping system comprises fence posts, fence rails, wire panels, having top wires, plasticized rail clips having wire recesses for locking the top wires therein, and plasticized double-locking-head arms. The plasticized rail clips and plasticized double-locking-head arms are for quickly and easily locking and releasing the top wires to and from the inside of the fence rails, respectively, such that the plasticized fence clipping system absorbs vibrations exerted on the fence and prevents the metal components of the fence from contacting and grinding against one another, to keep the fence quiet and to prevent the metal components from rusting. The plasticized fence clipping system is affordable and reliable, is quick and easy to install, requires no tools, saves materials, eliminates personal injuries, can be operated by hand, and requires only one person to install the fence.

20 Claims, 12 Drawing Sheets

(56) References Cited

U.S. PATENT DOCUMENTS

| | | | | |
|---|---|---|---|---|
| 4,037,788 | A | 7/1977 | Riley | |
| 4,078,772 | A | 3/1978 | Carbone | |
| 4,508,320 | A | 4/1985 | Hegarty | |
| 4,553,740 | A | 11/1985 | Bailey | |
| 4,893,788 | A | 1/1990 | Chave | |
| 5,110,094 | A * | 5/1992 | Kruse | E04H 17/10 256/47 |
| 5,120,025 | A | 6/1992 | D'Avanzo | |
| 5,328,156 | A * | 7/1994 | Hoke | E04H 17/02 256/1 |
| 5,402,988 | A * | 4/1995 | Eisele | E01F 13/022 160/351 |
| 5,496,016 | A | 3/1996 | Parisien | |
| 5,542,649 | A | 8/1996 | Allegaert | |
| 5,593,142 | A | 1/1997 | Gerhart | |
| 6,050,549 | A | 4/2000 | Foy | |
| 6,176,471 | B1 * | 1/2001 | Naegele | E04H 17/02 256/24 |
| D446,315 | S | 8/2001 | Forbis | |
| 6,415,564 | B1 * | 7/2002 | Beer | E04H 17/10 256/47 |
| D461,914 | S | 8/2002 | Hughes | |
| D471,284 | S | 3/2003 | Heath | |
| 7,789,376 | B2 * | 9/2010 | Diamond | E04H 17/161 256/54 |
| 7,866,635 | B2 * | 1/2011 | Payne | E04H 17/161 256/24 |
| 2004/0041142 | A1 * | 3/2004 | Morgan | E04H 17/1421 256/65.08 |
| 2005/0218393 | A1 * | 10/2005 | Larsen | E04H 17/161 256/32 |

* cited by examiner

FENCE CLIPPING SYSTEM HAVING FLEXIBLE ARM AND DOUBLE-LOCKING-HEAD ARM FOR HANGING FENCE PANELS ON ONE SIDE OF FENCE POSTS

REFERENCE TO PREVIOUSLY FILED PROVISIONAL PATENT APPLICATION

Provisional Patent Application No. 61/867,062 was filed on Aug. 17, 2013.

BACKGROUND OF THE INVENTION

1. Field of the Invention

The present invention relates to a fence clipping system. Particularly, the present invention relates to a unique plasticized fence clipping system having plasticized flexible arms and plasticized double-locking-head arms. The unique plasticized fence clipping system prevents the metal components of a fence from contacting and grinding against one another, and from squeaking and moaning, to keep the fence quiet and to prevent the metal components of the fence from rusting. The unique plasticized fence clipping system can quickly and easily locks and releases the wire panels of the fence to and from the inside of the fence rails of the fence, respectively. The unique plasticized fence clipping system is also durable and reliable, is easy and safe to install, eliminates personal injuries, can be operated by hand, requires no tools, and requires only one person to install the fence (it does not require many people like prior-art fences do).

2. Description of the Prior Art

A number of chain-link fences and chain-link-fence wire twists have been introduced. U.S. Pat. No. 221,878, filed Jul. 29, 1879, to Reuben L. Taylor; U.S. Pat. No. 351,244, filed Feb. 2, 1886, to John Baines; U.S. Pat. No. 379,706, filed Nov. 21, 1887, to Israel L. Landis; U.S. Pat. No. 385,531, filed Apr. 5, 1888, to Adam Shrader; U.S. Pat. No. 386,721, filed May 19, 1888, to Garret V. Rickards; U.S. Pat. No. 473,028, filed Jun. 26, 1890, to Richard C. Stewart; U.S. Pat. No. 603,628, filed Oct. 8, 1897, to Thomas B. Ferguson; U.S. Pat. No. 611,913, filed Feb. 19, 1898, to Harvey Kees; U.S. Pat. No. 1,407,540, filed Jul. 12, 1919, to Charles Holsinger; U.S. Pat. No. 2,218,954, filed Aug. 7, 1939, to Gustaf A. Gustafson; U.S. Pat. No. 2,800,305, filed Aug. 15, 1955, to Ambrose Gerstner; U.S. Pat. No. 2,863,642, filed May 10, 1955, to Louis Pagett; U.S. Pat. No. 3,045,976, filed Mar. 17, 1961, to Alfred E. Nayhouse; U.S. Pat. No. 3,486,739, filed Nov. 18, 1968, to Robert L. Nelson; U.S. Pat. No. 3,942,763, filed Feb. 4, 1974, to Arlen Helterbrand; U.S. Pat. No. 4,037,788, filed Dec. 3, 1975, to Harry D. Riley; U.S. Pat. No. 4,078,772, filed Feb. 12, 1976, to Michael Carbone; U.S. Pat. No. 4,508,320, filed Nov. 19, 1981, to Bernard L. Hegarty; U.S. Pat. No. 4,553,740, filed May 3, 1984, to Alan Bailey; U.S. Pat. No. 4,893,788, filed Oct. 24, 1988, to Barry J. Chave; U.S. Pat. No. 5,120,025, filed Oct. 22, 1990, to Battista D'Avanzo; U.S. Pat. No. 5,496,016, filed Jul. 12, 1994, to Harvey E. Parisien; U.S. Pat. No. 5,542,649, filed Oct. 6, 1994, to Marnix Allegaert; U.S. Pat. No. 5,593,142, filed Dec. 11, 1995, to Thomas L. Gerhart; U.S. Pat. No. 6,050,549, filed Feb. 3, 1998, to Bill D. Foy; U.S. Pat. No. D197,233, filed Mar. 7, 1963, to Irving R. Burnstine; U.S. Pat. No. D446,315, filed Jul. 28, 2000, to John T. Forbis; U.S. Pat. No. D461,914, filed Jan. 16, 2001, to Roderick E. Hughes; and U.S. Pat. No. D471,284, filed Mar. 14, 2002, to Randall D. Heath disclose a variety of inventions related to chain-link fences and chain-link-fence wire twists. The prior art has failed to solve many problems associated with such chain-link fences and chain-link-fence wire twists, as follows:

1) No prior-art fences offer or disclose any unique plasticized flexible rail clips of the unique fence clipping system, which can quickly and easily lock the top wires of unique wire panels to the inside of fence rails, and to absorb vibrations exerted on the unique wire panels while in use. As a result, while in use, the metal components of the prior-art fences contact and grind against one another, squeak and moan, and rust away. No prior-art fences have had any solution for the above-mentioned long-felt problems.

2) No prior-art fences offer or disclose any unique plasticized flexible rail clips of the unique fence clipping system, which can be operated by hand to quickly and easily lock the top wires of unique wire panels to the inside of fence rails, without using any tools. As a result, the prior-art fences require many different tools (for example, for the installation of a chain-link fence), require a lot of time, waste materials, are expensive, and cause a lot of personal injuries.

3) No prior-art fences offer or disclose any unique plasticized flexible rail clips of the unique fence clipping system, which can be operated by hand to quickly and easily release the top wires of unique wire panels from the inside of fence rails, without using any tools, to replace the unique wire panels. As a result, the prior-art fences require replacing the whole side of a fence when part of the fence is damaged, require many different tools (for example, for the replacement of the whole side of the chain-link fence), require a lot of time, waste materials, are expensive, and cause a lot of personal injuries.

4) No prior-art fences offer or disclose any unique plasticized flexible rail clips of the unique fence clipping system, which can be quickly and easily locked inside fence rails and protected from weather elements by the fence rails. As a result, the chain-link-fence wire twists of the prior-art fences are exposed to and not protected from weathering elements, and rust away. These long-felt problems shorten the durability, reliability, and service lifespan of the prior-art fences over time.

5) No prior-art fences offer or disclose any unique plasticized flexible rail clips of the unique fence clipping system, which can be operated by hand and only requires one person to quickly and easily lock unique wire panels continuously on one side of fence posts to create a fence, without using any tools. As a result, the installation of the prior-art fences requires many people, many different tools, and a lot of time (for example, the installation of a chain-link fence), wastes materials, is expensive, and causes a lot of personal injuries.

6) No prior-art fences offer or disclose any unique plasticized flexible rail clips of the unique fence clipping system, which can lock the dangerous top ends of the vertical wires of unique wire panels inside fence rails, to prevent them from poking, snagging, and cutting people to prevent personal injuries. As a result, the prior-art fences expose the dangerous top ends of their chain-link mesh, which poke, snag, cut people, and cause a lot of personal injuries over time.

7) No prior-art fences offer or disclose any unique wire panels of the unique fence clipping system, which are flat, easy and cheap to make, easy and cheap to transport, easy and cheap to install, easy and cheap to replace, and can be quickly and easily locked continuously on one side of fence posts to create a fence, without using any tools. As a result, the chain-link-mesh rolls of the prior-art fences are expensive and cumbersome, require a lot of time to install, cannot be precut at a factory, require expensive cutting tools to cut them on site, require a tremendous amount of cutting labor on site, and cause a lot of personal injuries.

8) No prior-art fences offer or disclose any unique wire panels and their unique advantages of the unique fence clipping system. As a result, many additional long-felt problems of the chain-link-mesh rolls of the prior-art fences are: a) They are cumbersome and dangerous to cut on site, b) They are not uniform, c) They require professional skills to install, c) They are very heavy, d) They require multiple people to carry them, and e) They require a lot of space for transportation and storage, and they cause a lot of personal injuries.

OBJECTS AND ADVANTAGES OF THE INVENTION

The present invention substantially departs from the conventional concepts and designs of the prior art (for example, FIG. 1 illustrates a prior-art fence and its wire twists 49 used on its fence rail to hang a chain-link mesh to build a chain-link fence). In doing so, the present invention provides a unique fence clipping system, having many unique functions and advantages, which overcome all the disadvantages of the prior art, as follows:

1) It is an object of the present invention to provide the unique fence clipping system, having unique plasticized flexible rail clips, which can be used to quickly and easily lock the top wires of unique wire panels to the inside of fence rails, to prevent the metal components of the fence from contacting and grinding against one another, and to absorb vibrations exerted on the unique wire panels while in use. As a result, the unique fence clipping system prevents the metal components of the fence from squeaking and moaning, to keep the fence quiet and to prevent the metal components of the fence from rusting (The unique fence clipping system solves the long-felt problems of the metal components of the fence squeaking and moaning, and rusting away).

2) It is another object of the present invention to provide the unique fence clipping system, having unique plasticized flexible rail clips, which can be operated by hand to quickly and easily lock the top wires of unique wire panels to the inside of fence rails, without using any tools. As a result, the unique fence clipping system eliminates the needs for tools, saves materials, saves time, saves money, and eliminates personal injuries.

3) It is another object of the present invention to provide the unique fence clipping system, having unique plasticized flexible rail clips, which can be operated by hand to quickly and easily release the top wires of unique wire panels from the inside of fence rails, without using any tools, to replace any of the unique wire panels. As a result, the unique fence clipping system eliminates the need for replacing the whole side of the fence when part of the fence is damaged by allowing replacing only a damaged wire panel, which eliminates the needs for tools, saves materials, saves time, saves money, and prevents personal injuries.

4) It is a further object of the present invention to provide the unique fence clipping system, having unique plasticized flexible rail clips, which can be quickly and easily locked inside fence rails and protected from weather elements by the fence rails. As a result, the unique plasticized flexible rail clips of the unique fence clipping system will last a long time and, therefore, extend the durability, reliability, and service lifespan of the unique fence clipping system.

5) It is an even further object of the present invention to provide the unique fence clipping system, having plasticized flexible rail clips, which can be operated by hand and only requires one person to quickly and easily lock unique wire panels continuously on one side of fence posts to install the fence, without using any tools. As a result, the unique fence clipping system eliminates the needs for multiple persons to install the fence, eliminates the needs for tools, eliminates personal injuries, reduces the amount of time needed to install the fence, saves materials, and, therefore, saves time and money.

6) It is still another object of the present invention to provide the unique fence clipping system, having unique plasticized flexible rail clips, which can be used to lock the dangerous top ends of the vertical wires of unique wire panels inside fence rails to prevent them from poking, snagging, and cutting people. As a result, the unique fence clipping system offers safety, protects people, protects the unique wire panels, and eliminates personal injuries, at the same times.

7) It is yet another object of the present invention to provide the unique wire panels of the unique fence clipping system, which can be quickly and easily locked continuously on one side of fence posts to install the fence, without using any tools. As a result, the unique wire panels of the unique fence clipping system are light and flat, eliminate the needs for using expensive chain-link-mesh rolls, reduce the amount of time needed to install the fence, can be precut at a factory, eliminate the needs for tools, eliminate the needs for cutting wires on site, save materials, save money, and eliminate personal injuries.

8) It is still an even further object of the present invention to provide the unique wire panels and their unique advantages of the unique fence clipping system. As a result, the unique wire panels of the unique fence clipping system are light, flat, stackable, aesthetic, affordable, easy to produce, easy to transport, easy to install, easy to replace, cheap to produce, cheap to transport, cheap to install, and cheap to replace (which solve all the long-felt disadvantages of the prior art of the expensive, cumbersome chain-link-mesh rolls of chain-link fences).

Other objects and advantages of the present invention will become apparent from the consideration of the accompanying drawings and ensuing description.

BRIEF DESCRIPTION OF THE DRAWINGS FIGURE

Figure 6B:
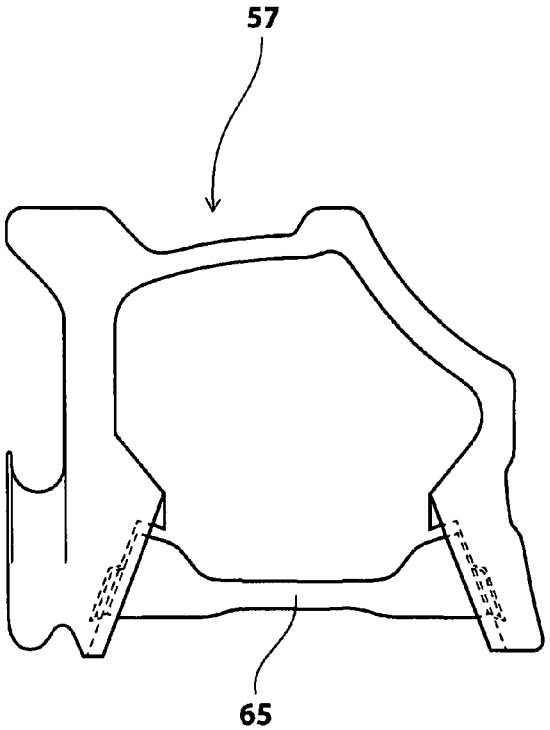
Figure 6A:
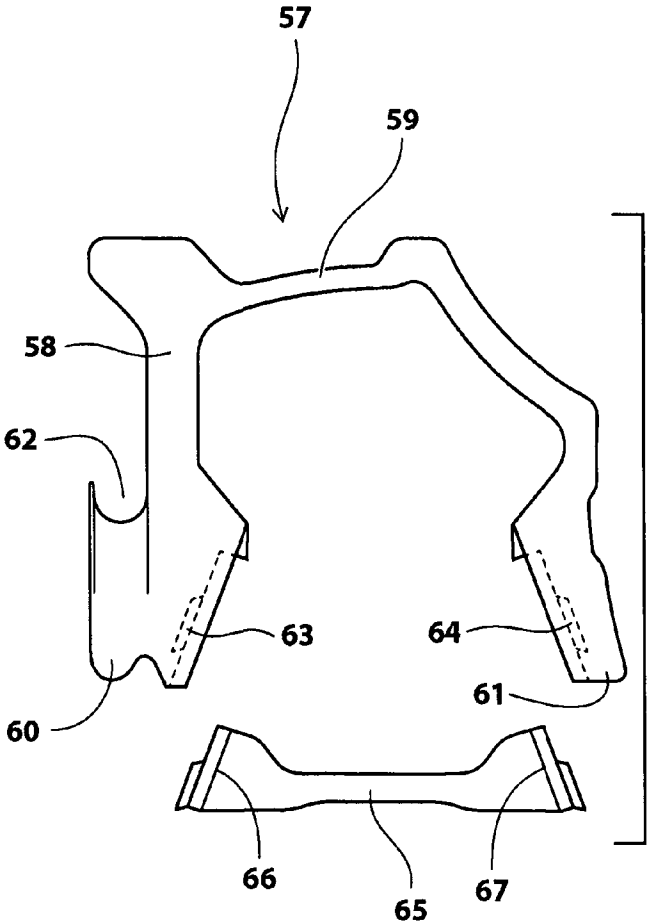

FIGS. 6*a* and 6*b* illustrate side views of a rail clip and a double-locking-head arm.

Figure 8:
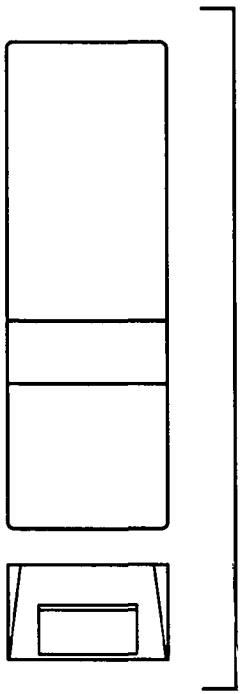
Figure 7:
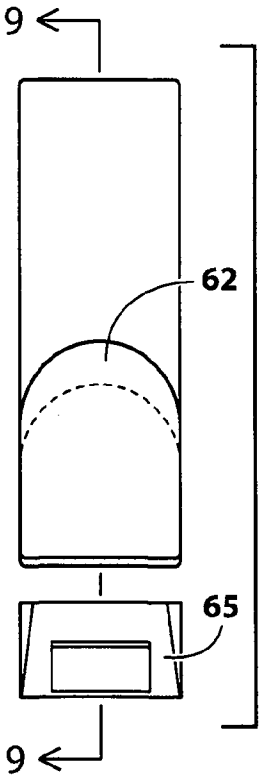

FIGS. 7 and 8 illustrate front and rear views of the rail clip and the double-locking-head arm.

Figure 9:
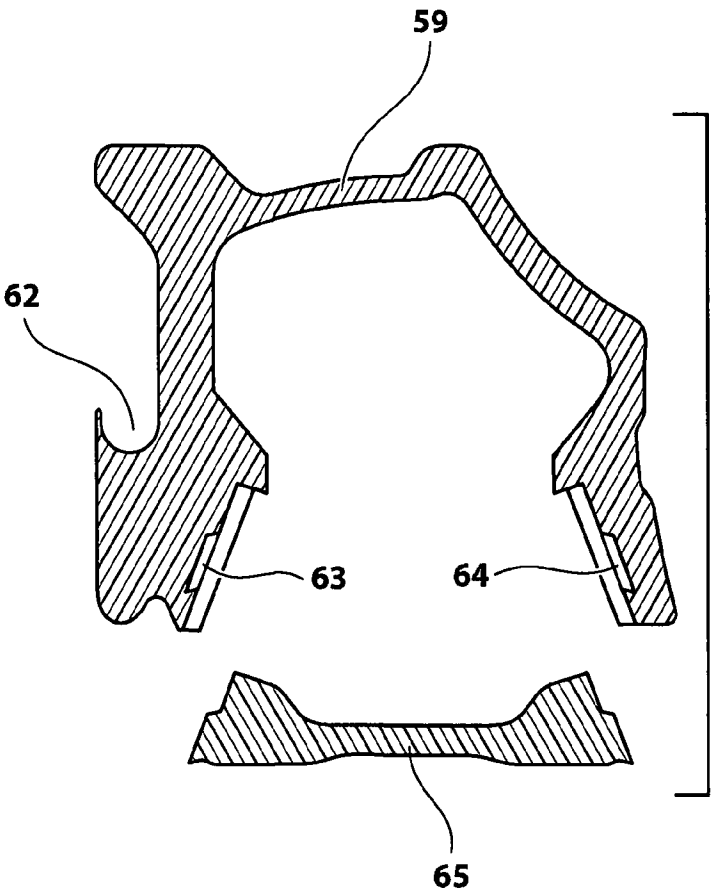

FIG. 9 illustrates a cross-sectional view of the rail clip and the double-locking-head arm.

Figure 10B:
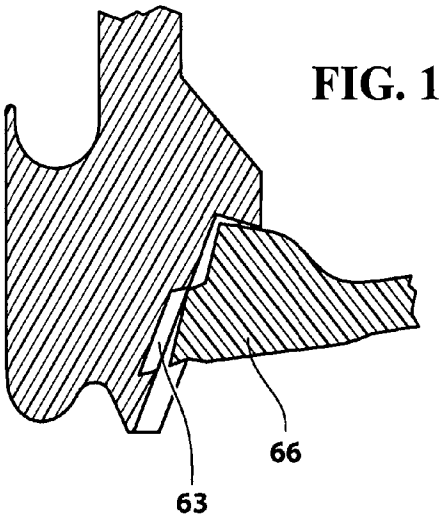
Figure 10C:
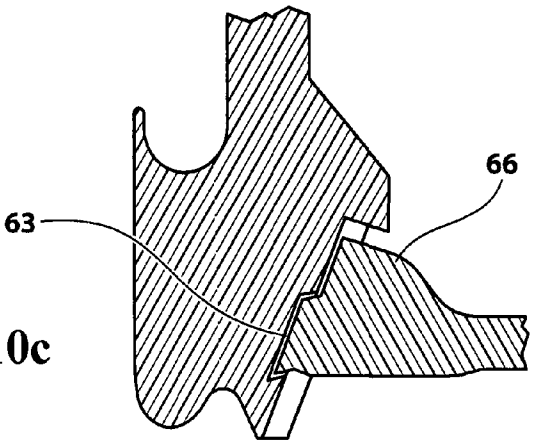
Figure 10A:
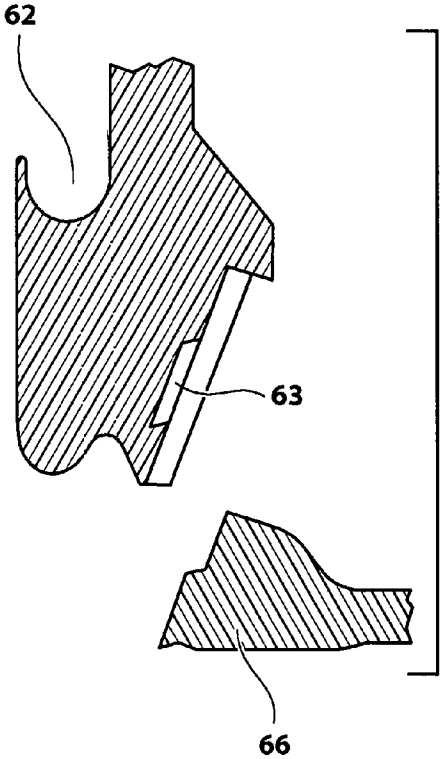

FIGS. 10*a*, 10*b*, and 10*c* illustrate how the double-locking-head arm locks in the body of the rail clip.

Figure 11:
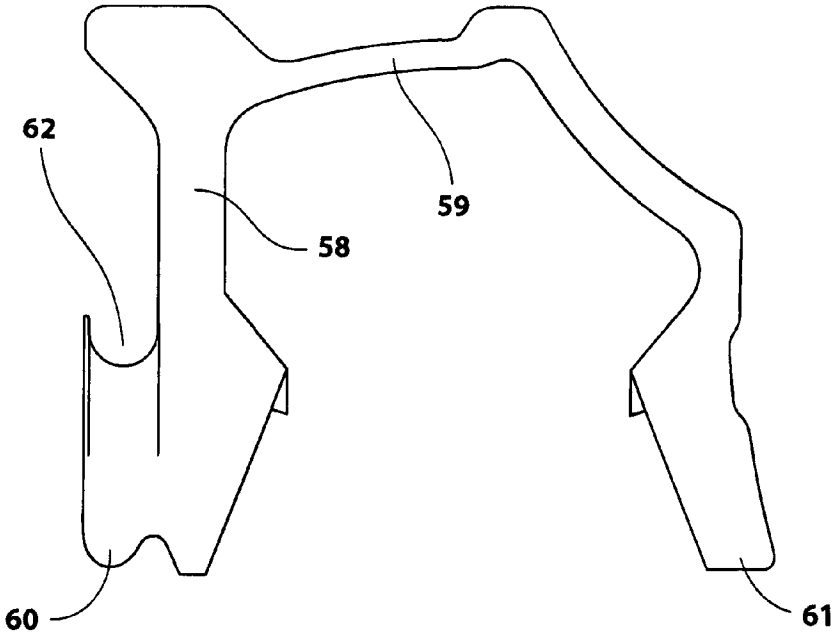
Figure 12:
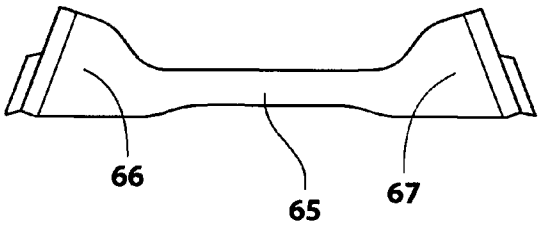

FIGS. 11 and 12 illustrate side views of the rail clip and the double-locking-head arm, respectively.

Figure 13B:
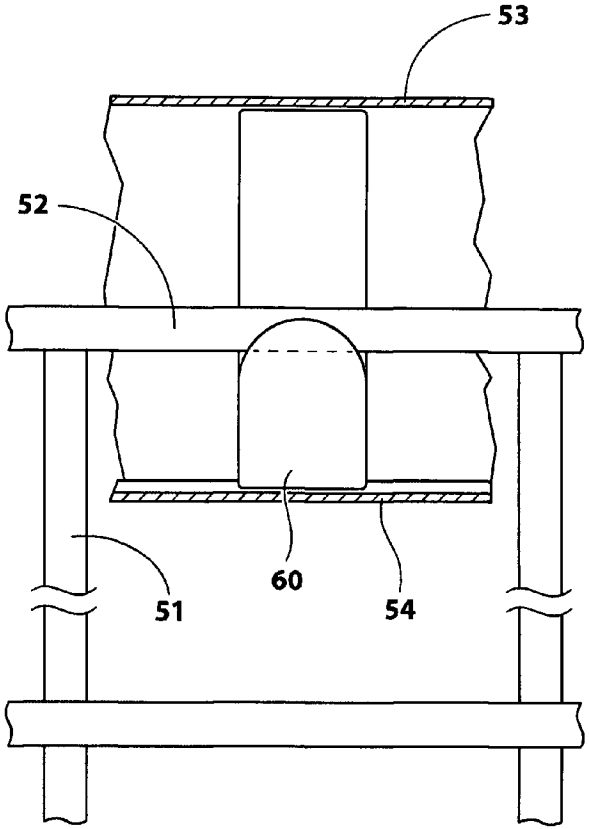
Figure 13A:
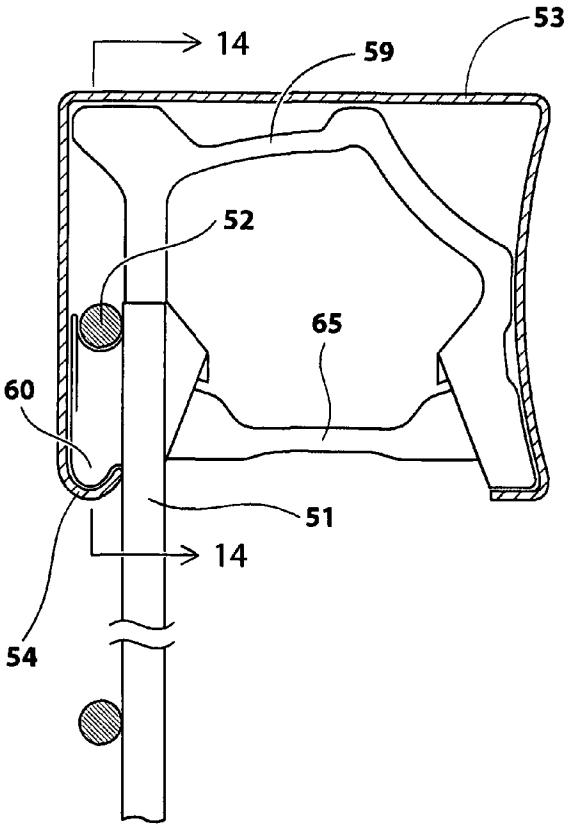

FIGS. 13*a* and 13*b* illustrate side and front views of the unique fence clipping system, respectively.

Figure 14:
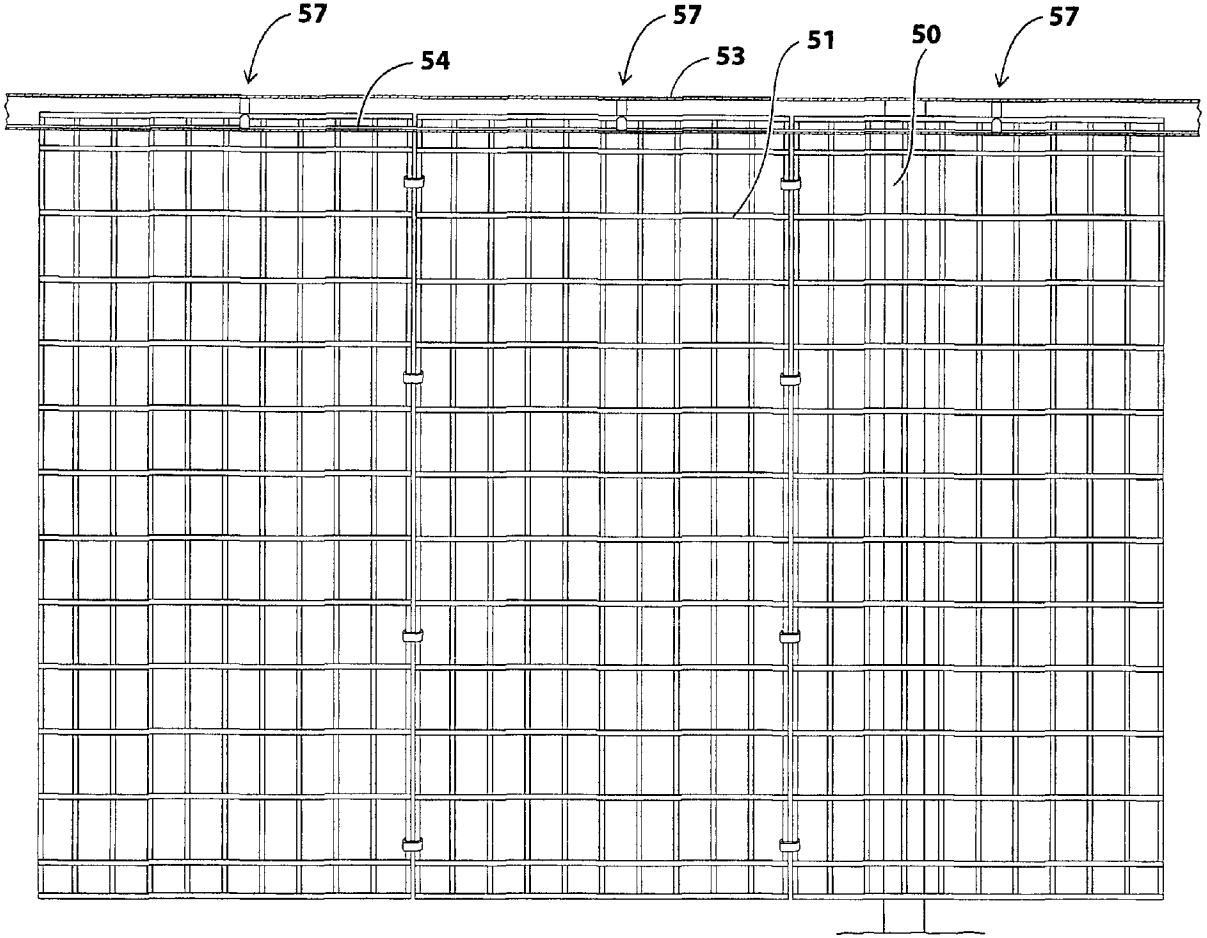
Figures 15A, 15B, 15C, 15D:
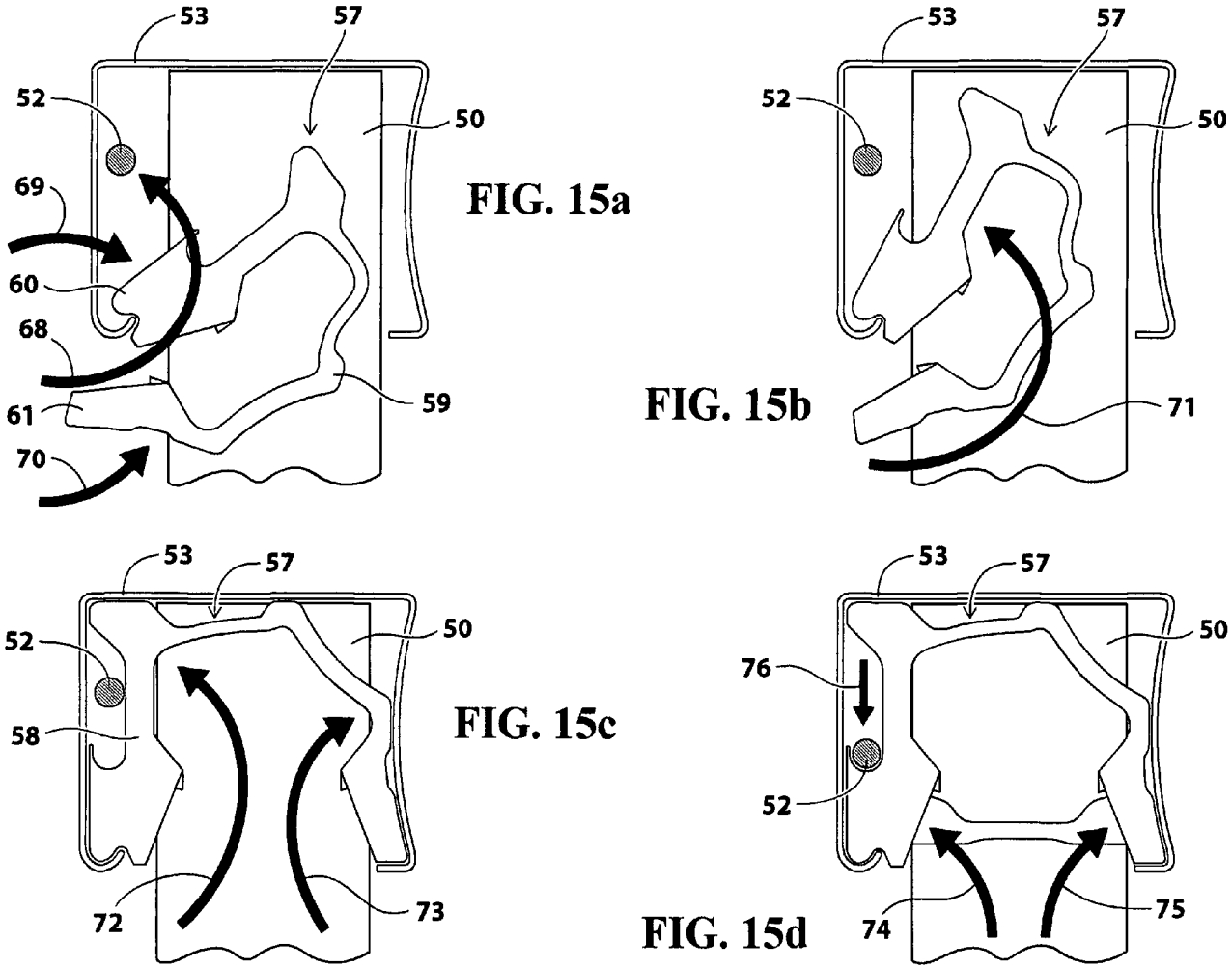

FIG. 14 illustrates a front view of the unique fence clipping system.

FIGS. 15*a*, 15*b*, 15*c*, and 15*d* illustrate how the unique fence clipping system works.

FIGS. 16*a*, 16*b*, 16*c*, and 16*d* illustrate a variation of the rail clip, and how it works.

SUMMARY OF THE INVENTION

A unique plasticized fence clipping system comprises fence posts, fence rails, wire panels, plasticized rail clips, and plasticized double-locking-head arms. The plasticized rail clips have wire recesses. The wire panels have top wires. The wire recesses are for locking the top wires therein. The plasticized rail clips and plasticized double-locking-head arms are for quickly and easily locking and releasing the top wires of the wire panels to and from the inside of the fence rails, respectively, such that the unique plasticized fence clipping system absorbs vibrations exerted on the fence and prevents the metal components of the fence from contacting and grinding against one another, and from squeaking and moaning, to keep the fence quiet and to prevent the metal components from rusting. The unique plasticized fence clipping system is also affordable and reliable, is quick and easy to install, requires no tools, saves materials, eliminates personal injuries, can be operated by hand, and requires only one person to install the fence.

DETAILED DESCRIPTION OF THE INVENTION

Component

Referring to FIGS. 2, 3, 4, and 5, the unique fence clipping system comprises:

1) Fence posts 50,
2) Wire panels 51,
3) Top wires 52,
4) Fence rails 53,
5) First rail lips 54,
6) Second rail lips 55,
7) Rail openings 56,
8) Rail clips 57,
9) Clip bodies 58,
10) Flexible arms 59,
11) First clip ends 60,
12) Second clip ends 61,
13) Wire recesses 62,
14) First locking-head recesses 63,
15) Second locking-head recesses 64,
16) Double-locking-head arms 65,
17) First locking heads 66, and
18) Second locking heads 67.

Material

Referring to FIGS. 2, 3, 4, and 5:

1) Fence posts 50 are made of metallic material.
2) Wire panels 51 are made of metallic material.
3) Top wires 52 are made of metallic material.
4) Fence rails 53 are made of metallic material.
5) First rail lips 54 are made of metallic material.
6) Second rail lips 55 are made of metallic material.
7) Rail openings 56 are made of empty space.
8) Rail clips 57 are made of plasticized material.
9) Clip bodies 58 are made of plasticized material.
10) Flexible arms 59 are made of plasticized material.
11) First clip ends 60 are made of plasticized material.
12) Second clip ends 61 are made of plasticized material.
13) Wire recesses 62 are made of empty space.
14) First locking-head recesses 63 are made of empty space.
15) Second locking-head recesses 64 are made of empty space.
16) Double-locking-head arms 65 are made of plasticized material.
17) First locking heads 66 are made of plasticized material.
18) Second locking heads 67 are made of plasticized material.

Shape

Referring to FIGS. 6*a*, 6*b*, 7, 8, 9, 10*a*, 10*b*, and 10*c*:

1) Fence posts 50 each have an elongated, rectangular-cross-sectional shape.
2) Wire panels 51 each have a rectangular shape.
3) Top wires 52 each have an elongated, round-cross-sectional shape.
4) Fence rails 53 each have an elongated, U-cross-sectional shape.
5) First rail lips 54 each have an elongated C-shape.
6) Second rail lips 55 each have an elongated I-shape.
7) Rail openings 56 each have an elongated I-shape.
8) Rail clips 57 each have a U-shape.
9) Clip bodies 58 each have an I-shape.
10) Flexible arms 59 each have a V-shape.
11) First clip ends 60 each have an I-shape.
12) Second clip ends 61 each have an I-shape.
13) Wire recesses 62 each have a half-moon shape.
14) First locking-head recesses 63 each have a cup shape.
15) Second locking-head recesses 64 each have a cup shape.
16) Double-locking-head arms 65 each have a dumb-bell shape.
17) First locking heads 66 each have a cup shape.
18) Second locking heads 67 each have a cup shape.

Connection

Referring to FIGS. 11, 12, 13*a*, 13*b*, and 14:

1) Fence posts 50 are connected to fence rails 53, at their ends.
2) Wire panels 51 are created from welding many panel wires 52 together.
3) Top wires 52 are welded to other panel wires to create wire panels 51.
4) Fence rails 53 are connected to fence posts 50, at their ends.
5) First rail lips 54 are molded to and along fence rails 53, at their edges.
6) Second rail lips 55 are molded to and along fence rails 53, at their opposite edges.
7) Rail openings 56 are disposed between and along first and second rail lips 54 and 55.
8) Rail clips 57 are locked inside fence rails 53.
9) Clip bodies 58 are molded to flexible arms 59, at their ends.
10) Flexible arms 59 are molded to clip bodies 58, at their ends.
11) First clip ends 60 are molded to clip bodies 58, at their other ends.
12) Second clip ends 61 are molded to flexible arms 59, at their other ends.
13) Wire recesses 62 are molded in first clip ends 60, on their outer surfaces.
14) First locking-head recesses 63 are molded in first clip ends 60, on their inner surfaces.
15) Second locking-head recesses 64 are molded in second clip ends 61, on their inner surfaces.
16) Double-locking-head arms 65 are locked to first and second clip ends 60 and 61.
17) First locking heads 66 are molded to double-locking-head arms 65, at their ends.

18) Second locking heads 67 are molded to double-locking-head arms 65, at their other ends.

Function

Referring to FIGS. 11, 12, 13*a*, 13*b*, and 14:

1) Fence posts 50 are for supporting fence rails 53.
2) Wire panels 51 are for creating a barrier for the fence.
3) Top wires 52 are for being welded with other panel wires to create wire panels 51.
4) Fence rails 53 are for locking rail clips 57 therein.
5) First rail lips 54 are for first clip ends 60 to rest thereon.
6) Second rail lips 55 are for second clip ends 61 to rest thereon.
7) Rail openings 56 are for rail clips 57 to be inserted therethrough into the inside of fence rails 53.
8) Rail clips 57
   are for preventing wire panels 51 and fence rails 53
      from contacting and grinding against each other,
      to prevent wire panels 51 and fence rails 53 from squeaking, moaning, and rusting,
      to keep wire panels 51 and fence rails 53 quiet, and
   are for locking top wires 52 of wire panels 51 continuously inside fence rails 53,
      to lock wire panels 51 continuously on one side of fence posts 50.
9) Clip bodies 58
   are for preventing wire panels 51 and fence rails 53
      from contacting and grinding against each other,
      to prevent wire panels 51 and fence rails 53 from squeaking, moaning, and rusting,
      to keep wire panels 51 and fence rails 53 quiet, and
   are for locking top wires 52 of wire panels 51 continuously inside fence rails 53,
      to lock wire panels 51 continuously on one side of fence posts 50.
10) Flexible arms 59
   are for absorbing vibrations exerted on wire panels 51 and fence rails 53 while in use, and
   are for being able to fold inwards to shrink the width of rail clips 57
      to allow rail clips 57 to be inserted through rail openings 56 into the inside of fence rails 53,
11) First clip ends 60 are for resting on first rail lips 54.
12) Second clip ends 61 are for resting on second rail lips 55.
13) Wire recesses 62 are for top wires 52 to rest therein.
14) First locking-head recesses 63 are for first locking heads 66 to be locked therein.
15) Second locking-head recesses 64 are for second locking heads 67 to be locked therein.
16) Double-locking-head arms 65 are for pushing first and second locking heads 66 and 67 into first and second locking-head recesses 63 and 64, respectively.
17) First locking heads 66 are for locking double-locking-head arms 65 to rail clips 57 to lock rail clips 57 inside fence rails 53.
18) Second locking heads 67 are for locking double-locking-head arms 65 to rail clips 57 to lock rail clips 57 inside fence rails 53.

Operation

Referring to FIGS. 14, 15*a*, 15*b*, 15*c*, and 15*d*, the operation of the unique fence clipping system comprises the following steps:

1) Inserting the ends of fence posts 50 into the ground
   such that fence posts 50 are perpendicular with the ground;
2) Inserting the other ends of fence posts 50 into the inside of fence rails 53
   such that fence rails 53 are parallel with the ground;
3) Inserting top wires 52 through rail openings 56 into the inside of fence rails 53,
   in the direction of arrow 68 (see FIG. 15*a*);
4) Squeezing first and second clip ends 60 and 61 toward each other,
   in the directions of arrows 69 and 70 (see FIG. 15*a*), to fold flexible arms 59 inwards;
5) Hooking first clip ends 60 on first rail lips 54 (see FIG. 15*a*);
6) Rotating rail clips 57 through rail openings 56 into the inside of fence rails 53,
   in the direction of arrow 71 (see FIG. 15*b*);
7) Rotating clip bodies 58 into the inside of fence rails 53,
   in the direction of arrow 72 (see FIG. 15*c*);
8) Releasing first and second clip ends 60 and 61,
   in the direction of arrow 73 (see FIG. 15*c*), to unfold flexible arms 59,
   such that flexible arms 59 return to their original form and dimension;
9) Snap-locking first and second locking heads 66 and 67 in first and second locking-head recesses 63 and 64, in the directions of arrows 74 and 75, respectively (see FIG. 15*d*),
   such that rail clips 57 and double-locking-head arms 65
      prevent wire panels 51 and fence rails 53
      from contacting and grinding against each other,
      to prevent wire panels 51 and fence rails 53
      from squeaking, moaning, and rusting, and
      to keep wire panels 51 and fence rails 53 quiet, and
   such that rail clips 57 and double-locking-head arms 65
      lock themselves and top wires 52 continuously inside fence rails 53, and
      lock wire panels 51 continuously on one side of fence posts 50;
10) Locking top wires 52 of wire panels 51 in wire recesses 62,
   in the direction of arrow 76 (see FIG. 15*d*); and
11) Screwing fence rails 53 to fence posts 50 to secure fence rails 53 to fence posts 50.

Variation

Figure 16A:
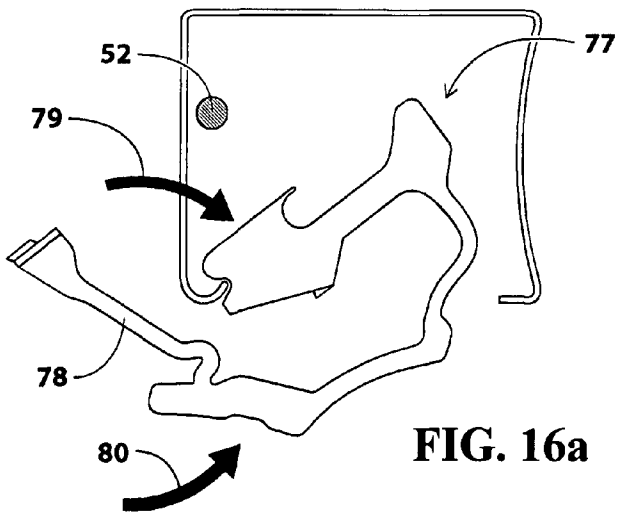
Figure 16B:
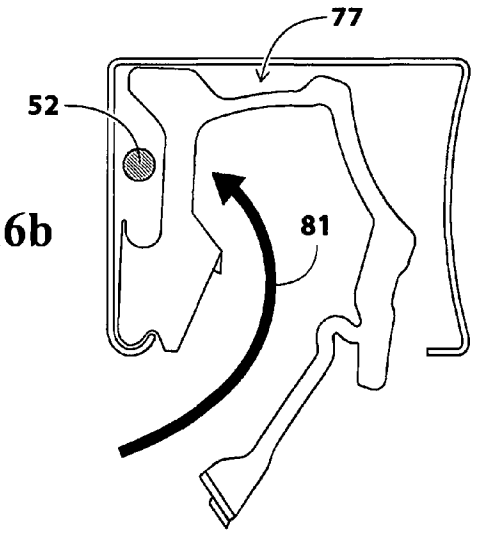
Figure 16C:
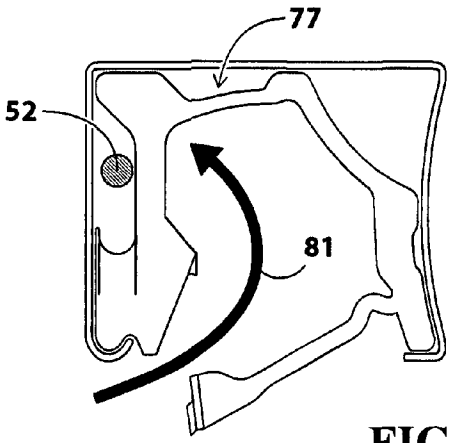
Figure 16D:
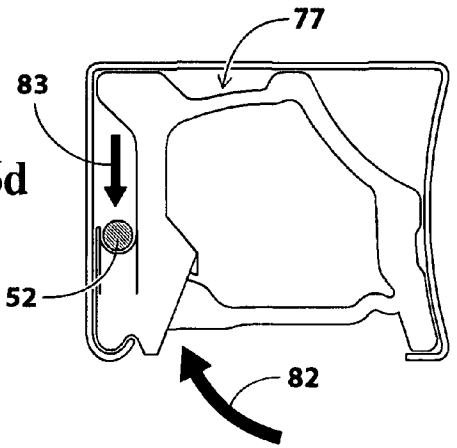

Referring to FIGS. 16*a*, 16*b*, 16*c*, and 16*d*, an equivalent to rail clip 57 can be a rail clip 77 having a similar double-locking-head arm 78. One end of double-locking-head arm 78 can be molded to the second clip end of rail clip 77. Similarly to rail clip 57, rail clip 77 can be squeezed to reduce its width in the directions of arrows 79 and 80 (FIG. 16*a*), hooked on the rail lip of fence rail 53 (FIG. 16*b*), rotated into the inside of fence rail 53 in the direction of arrow 81 (FIG. 16*c*), and locked inside fence rail 53 in the direction of arrow 82 (FIG. 16*d*). Then, top wire 52 can be dropped down into the wire recess of rail clip 77 in the direction of arrow 83 (FIG. 16*d*). Fence posts 50, wire panels 51, and fence rails 53 can be powder-coated.

Major Benefits

Figure 1:
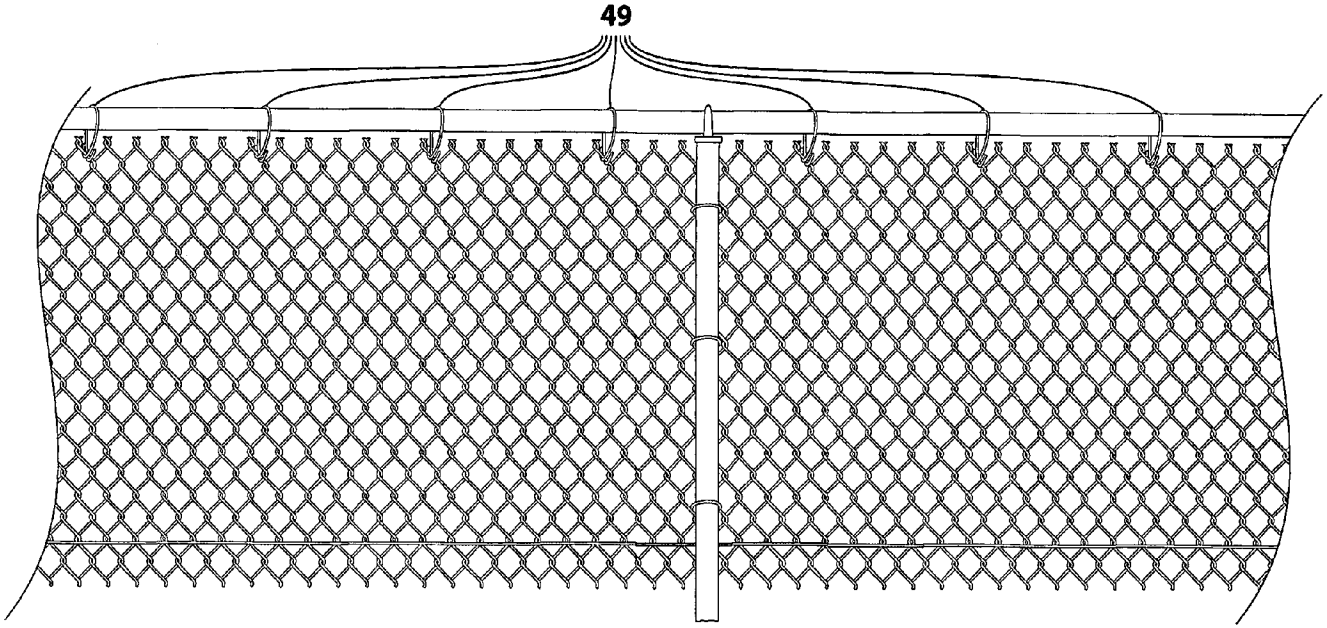
FIG. 1 (PRIOR ART)
FIG. 1 (PRIOR ART) illustrates a front view of a chain-link fence.
Figure 2:
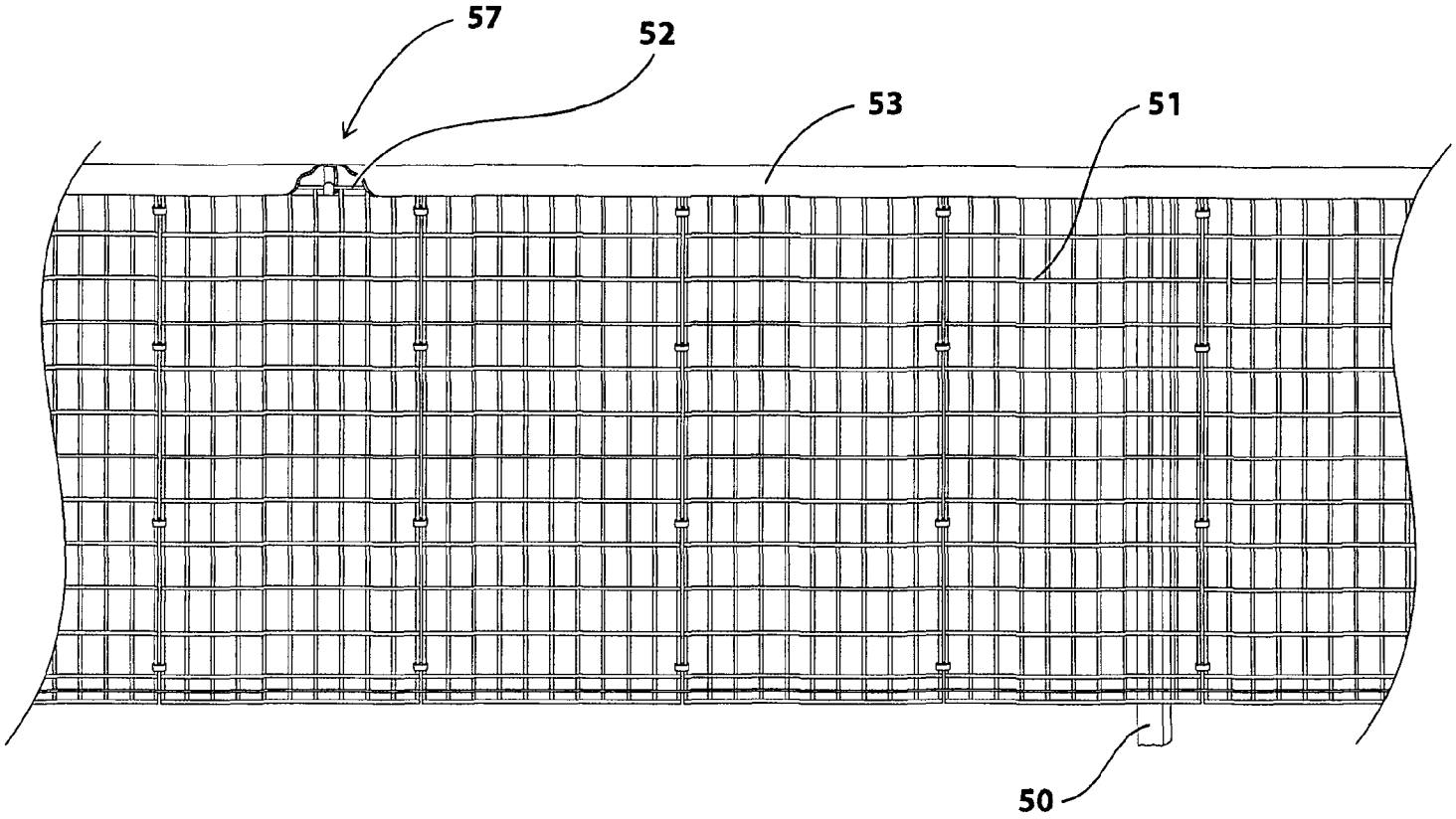
FIG. 2 illustrates a front view of the unique fence clipping system.
Figure 4:
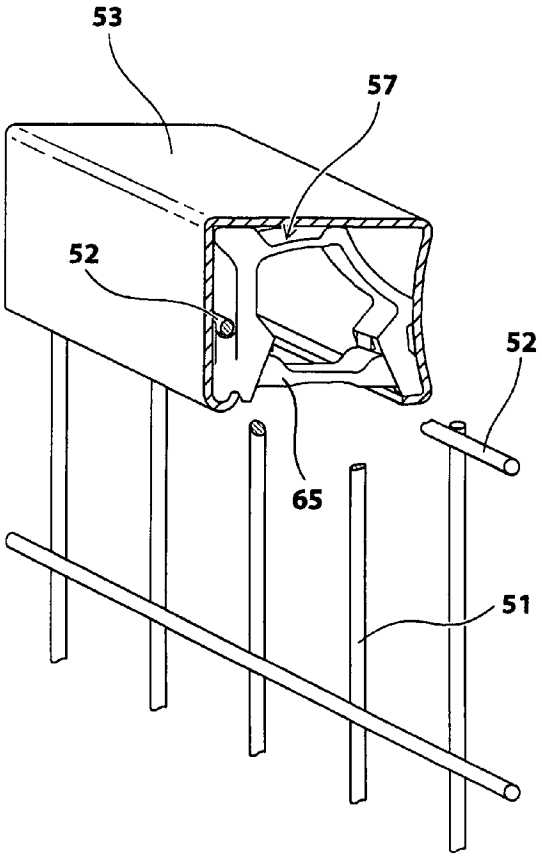
FIGS. 3 and 4 illustrate an inside view of the unique fence clipping system.
Figure 3:
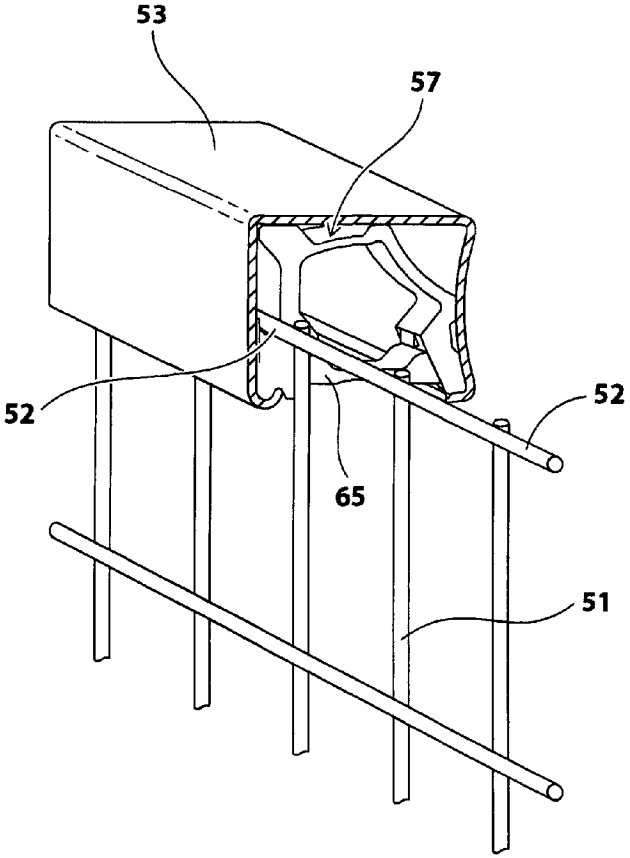
Figure 5:
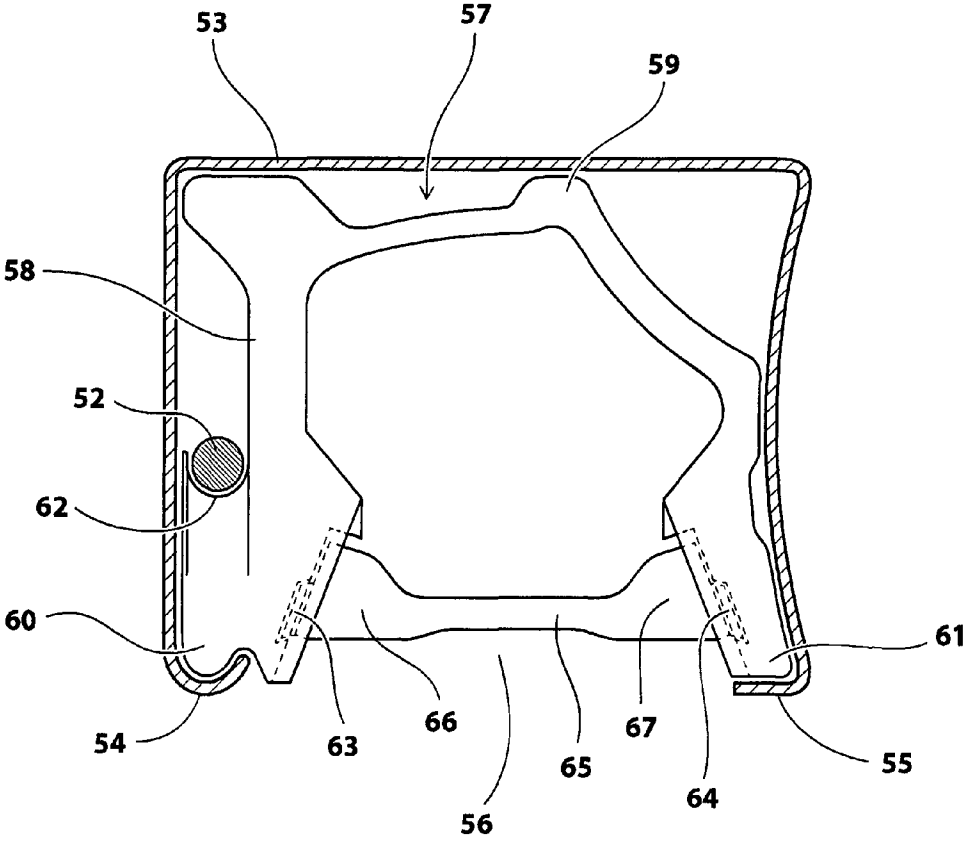
FIG. 5 illustrates a side view of the unique fence clipping system.

Referring to FIGS. 14, 15*a*, 15*b*, 15*c*, and 15*d*:

The present invention substantially departs from the conventional concepts and designs of the prior art (for example, FIG. 1 illustrates a prior-art fence and its wire twists 49 used on its fence rail to hang a chain-link mesh to build a chain-link fence). In doing so, the present invention provides a unique fence clipping system, having many unique functions and advantages, which overcome all the disadvantages of the prior art, as follows:

1) It is an object of the present invention to provide the unique fence clipping system, having unique plasticized flexible rail clips 57, which can be used to quickly and easily lock top wires 52 of unique wire panels 51 to the inside of fence rails 53, to prevent the metal components of the fence from contacting and grinding against one another, and to absorb vibrations exerted on unique wire panels 51 while in use. As a result, the unique fence clipping system prevents the metal components of the fence from squeaking and moaning, to keep the fence quiet and to prevent the metal components of the fence from rusting (The unique fence clipping system solves the long-felt problems of the metal components of the fence squeaking and moaning, and rusting away).

2) It is another object of the present invention to provide the unique fence clipping system, having unique plasticized flexible rail clips 57, which can be operated by hand to quickly and easily lock top wires 52 of unique wire panels 51 to the inside of fence rails 53, without using any tools. As a result, the unique fence clipping system eliminates the needs for tools, saves materials, saves time, saves money, and eliminates personal injuries.

3) It is another object of the present invention to provide the unique fence clipping system, having unique plasticized flexible rail clips 57, which can be operated by hand to quickly and easily release top wires 52 of unique wire panels 51 from the inside of fence rails 53, without using any tools, to replace any of unique wire panels 51. As a result, the unique fence clipping system eliminates the need for replacing the whole side of the fence when part of the fence is damaged by allowing replacing only a damaged wire panel 51, which eliminates the needs for tools, saves materials, saves time, saves money, and prevents personal injuries.

4) It is a further object of the present invention to provide the unique fence clipping system, having unique plasticized flexible rail clips 57, which can be quickly and easily locked inside fence rails 53 and protected from weather elements by fence rails 53. As a result, unique plasticized flexible rail clips 57 of the unique fence clipping system will last a long time and, therefore, extend the durability, reliability, and service lifespan of the unique fence clipping system.

5) It is an even further object of the present invention to provide the unique fence clipping system, having plasticized flexible rail clips 57, which can be operated by hand and only requires one person to quickly and easily lock unique wire panels 51 continuously on one side of fence posts 50 to install the fence, without using any tools. As a result, the unique fence clipping system eliminates the needs for multiple persons to install the fence, eliminates the needs for tools, eliminates personal injuries, reduces the amount of time needed to install the fence, saves materials, and, therefore, saves time and money.

6) It is still another object of the present invention to provide the unique fence clipping system, having unique plasticized flexible rail clips 57, which can be used to lock the dangerous top ends of the vertical wires of unique wire panels 51 inside fence rails 53 to prevent them from poking, snagging, and cutting people. As a result, the unique fence clipping system offers safety, protects people, protects unique wire panels 51, and eliminates personal injuries, at the same times.

7) It is yet another object of the present invention to provide unique wire panels 51 of the unique fence clipping system, which can be quickly and easily locked continuously on one side of fence posts 50 to install the fence, without using any tools. As a result, unique wire panels 51 of the unique fence clipping system are light and flat, eliminate the needs for using expensive chain-link-mesh rolls, reduce the amount of time needed to install the fence, can be precut at a factory, eliminate the needs for tools, eliminate the needs for cutting wires on site, save materials, save money, and eliminate personal injuries.

8) It is still an even further object of the present invention to provide unique wire panels 51 and their unique advantages of the unique fence clipping system. As a result, unique wire panels 51 of the unique fence clipping system are light, flat, stackable, aesthetic, affordable, easy to produce, easy to transport, easy to install, easy to replace, cheap to produce, cheap to transport, cheap to install, and cheap to replace (which solve all the long-felt disadvantages of the prior art of the expensive, cumbersome chain-link-mesh rolls of chain-link fences).

What is claimed is:

1. A fence system, for building a wire-panel fence, comprising:

a plurality of fence posts,
a plurality of wire panels,
a plurality of fence rails,
a plurality of rail clips, and
a plurality of locking arms,
said fence posts each being made of metallic material,
said fence posts each having an elongated, rectangular-cross-sectional shape,
said fence posts each having
a first fence-post end and
a second fence-post end,
said first fence-post ends
for being buried in the ground,
said second fence-post ends
for being inserted into said fence rails
to support said fence rails, respectively,
said wire panels each being made of metallic material,
said wire panels each having a rectangular shape,
said wire panels each having
a top wire,
said top wires
for being inserted into said fence rails, respectively,
said fence rails each being made of metallic material,
said fence rails each having an elongated, U-cross-sectional shape,
said fence rails each having
a first rail lip and
a second rail lip,
said fence rails
for said rail clips and said locking arms to be inserted therein
to protect said rail clips and said locking arms from weather elements, and
for said top wires to be inserted therein
to prevent said top wires from poking and cutting people,
said rail clips each being made of semi-rigid material,
said rail clips each having a U-shape,
said rail clips each comprising
a clip body and
a flexible arm,
said clip body having a clip-body end,
said flexible arm having a flexible-arm end,
said clip-body end being molded to said flexible-arm end,
said clip body having
an inner surface,
an outer surface,
a locking-arm recess, and
a top-wire recess,
said locking-arm recess being molded into said inner surface, said top-wire recess being molded into said outer surface,
said rail clips being inserted in said fence rails such that
said clip bodies and said flexible arms hook on said first and said second rail lips, respectively,
said flexible arms
for absorbing vibrations exerted on said wire panels and said fence rails, and
for being folded inwards
to allow said rail clips to be inserted into said fence rails,
said locking arms each being made of semi-rigid material,
said locking arms each having an I-shape,
said locking arms each having
a first locking-arm end and
a second locking-arm end,
said first locking-arm end being molded to said flexible arm,
said second locking-arm end
for being snap-locked in said locking-arm recess of said clip body,
said top wires
for being snap-locked in said top-wire recess of said clip body,
whereby said rail clips and said locking arms are
for preventing said wire panels and said fence rails from contacting and grinding against each other,
to prevent said wire panels and said fence rails from squeaking, moaning, and rusting,
for locking said top wires inside said fence rails,
to prevent said top wires from poking and cutting people,
for keeping said wire panels and said fence rails quiet,
for absorbing vibrations exerted on said wire panels,
for locking said wire panels inside said fence rails,
to protect said wire panels from weather elements,
for locking said wire panels to said fence rails, and
for locking said wire panels on one side of said fence posts,
for eliminating using tools when installing said wire panels, and
whereby the fence system:
can be assembled and disassembled quickly and easily by hand,
can be assembled and disassembled quickly and easily without using any tools,
can be assembled and disassembled quickly and easily by one person,
is quick and easy to install and to replace,
is easy and cheap to produce and to use,
is flat and easy to transport, to stack, and to store,
saves materials, time, and money,
offers safety, affordability, and convenience,
simplifies fence installation and replacement,
reduces fence-installation and fence-replacement time,
eliminates the needs for tools,
eliminates the needs for cutting wires on site, and
eliminates personal injuries.

2. The fence system of claim 1, wherein, said locking-arm recesses each have a cup shape.

3. The fence system of claim 1, wherein, said top-wire recesses each have a cup shape.

4. The fence system of claim 1, wherein, said rail clips are made of nylon.

5. The fence system of claim 1, wherein, said rail clips are made of plasticized material.

6. The fence system of claim 1, wherein, said locking arms are made of nylon.

7. The fence system of claim 1, wherein, said locking arms are made of plasticized material.

8. The fence system of claim 1, wherein, said fence posts, wire panels, and fence rails are made of steel.

9. The fence system of claim 1, wherein, said fence posts, wire panels, and fence rails are made of iron.

10. The fence system of claim 1, wherein, said locking arms are made of plasticized material.

11. A fence system, for building a wire-panel fence, comprising:
a plurality of fence posts,
a plurality of wire panels,
a plurality of fence rails,
a plurality of rail clips, and
a plurality of locking arms,
said fence posts each being made of metallic material,
said fence posts each having
a first fence-post end and
a second fence-post end,
said first fence-post ends
for being buried in the ground,
said second fence-post ends
for being inserted into said fence rails
to support said fence rails, respectively,
said wire panels each being made of metallic material,
said wire panels each having
a top wire,
said top wires
for being inserted into said fence rails, respectively,
said fence rails each being made of metallic material,
said fence rails each having an elongated, U-cross-sectional shape,
said fence rails each having
a first rail lip and
a second rail lip,
said fence rails
for said rail clips and said locking arms to be inserted therein
to protect said rail clips and said locking arms from weather elements, and
for said top wires to be inserted therein
to prevent said top wires from poking and cutting people,
said rail clips each being made of semi-rigid material,
said rail clips each comprising
a clip body and
a flexible arm,
said clip body having a clip-body end,
said flexible arm having a flexible-arm end,
said clip-body end being molded to said flexible-arm end,
said clip body having
an inner surface,
an outer surface,
a locking-arm recess, and
a top-wire recess,
said locking-arm recess being molded into said inner surface,
said top-wire recess being molded into said outer surface,
said rail clips being inserted in said fence rails such that
said clip bodies and said flexible arms hook on said first and said second rail lips, respectively,
said flexible arms for absorbing vibrations exerted on said wire panels and said fence rails, and
for being folded inwards
to allow said rail clips to be inserted into said fence rails,
said locking arms each being made of semi-rigid material,
said locking arms each having
a first locking-arm end and
a second locking-arm end,
said first locking-arm end being molded to said flexible arm,
said second locking-arm end
for being snap-locked in said locking-arm recess of said clip body,
said top wires
for being snap-locked in said top-wire recess of said clip body,
whereby said rail clips and said locking arms are
for preventing said wire panels and said fence rails
from contacting and grinding against each other;
to prevent said wire panels and said fence rails
from squeaking, moaning, and rusting,
for locking said top wires inside said fence rails,
to prevent said top wires from poking and cutting people,
for keeping said wire panels and said fence rails quiet,
for absorbing vibrations exerted on said wire panels,
for locking said wire panels inside said fence rails,
to protect said wire panels from weather elements,
for locking said wire panels to said fence rails, and
for locking said wire panels on one side of said fence posts,
for eliminating using tools when installing said wire panels.

12. The fence system of claim 11, wherein, said fence posts each have a rectangular cross section.

13. The fence system of claim 11, wherein, said fence posts each have a round cross section.

14. The fence system of claim 11, wherein, said wire panels each have a rectangular shape.

15. The fence system of claim 11, wherein, said wire panels each have a square shape.

16. The fence system of claim 11, further, comprising a plurality of screws, wherein, said screws are for screwing said fence rails to said fence posts, respectively.

17. The fence system of claim 11, wherein, said rail clips are made of nylon.

18. The fence system of claim 11, wherein, said rail clips are made of plasticized material.

19. A method for building a wire-panel fence,
provided a fence system,
the fence system comprising:
a plurality of fence posts,
a plurality of wire panels,
a plurality of fence rails,
a plurality of rail clips, and
a plurality of locking arms,
said fence posts each being made of metallic material,
said fence posts each having an elongated, rectangular-cross-sectional shape,
said fence posts each having
a first fence-post end and
a second fence-post end,
said wire panels each being made of metallic material,
said wire panels each having a rectangular shape,
said wire panels each having
a top wire,
said fence rails each being made of metallic material,
said fence rails each having an elongated, U-cross-sectional shape,
said fence rails each having
a first rail lip and
a second rail lip,
said rail clips each being made of semi-rigid material,
said rail clips each having a U-shape,
said rail clips each comprising
a clip body and
a flexible arm,
said clip body having a clip-body end,
said flexible arm having a flexible-arm end,
said clip-body end being molded to said flexible-arm end,
said clip body having
an inner surface,
an outer surface,
a locking-arm recess, and
a top-wire recess,
said locking-arm recess being molded into said inner surface,
said top-wire recess being molded into said outer surface,
said locking arms each being made of semi-rigid material,
said locking arms each having an I-shape,
said locking arms each having
a first locking-arm end and
a second locking-arm end,
said first locking-arm end being molded to said flexible arm,
the method comprising the steps of:
burying said first fence-post ends into the ground,
inserting said second fence-post ends into said fence rails, respectively,
inserting said top wires into said fence rails, respectively,
squeezing said clip bodies and said flexible arms, respectively,
inserting said rail clips into said fence rails, respectively,
releasing said clip bodies and said flexible arms, respectively,
hooking said clip bodies and said flexible arms on said first and said second rail lips, respectively,
locking said top wires in said top-wire recesses, respectively, and
snap-locking said second locking-arm ends into said locking-arm recesses, respectively.

20. The method of claim 19, the fence system further comprising a plurality of screws, the method further comprising the step of
screwing said fence rails to said fence posts with said screws, respectively.

* * * * *